United States Patent [19]

Novotny et al.

[11] 4,446,638

[45] May 8, 1984

[54] DIPPER TIP RETAINING PIN

[75] Inventors: Raymond J. Novotny, Sparta; James P. Mulder, Oakland, both of N.J.

[73] Assignee: Abex Corporation, Stamford, Conn.

[21] Appl. No.: 453,437

[22] Filed: Dec. 27, 1982

[51] Int. Cl.[3] ..... E02F 9/28

[52] U.S. Cl. ..... 37/142 A; 403/379

[58] Field of Search ..... 37/142 A, 142 R, 141 T; 101/376; 403/378, 379, 324

[56] References Cited

U.S. PATENT DOCUMENTS 3,685,178 8/1972 Ratkowski ..... 37/142 A 3,727,547 4/1973 Wilde ..... 101/376 X 4,192,089 3/1980 Schwappach ..... 37/142 A

*Primary Examiner*—Edgar S. Burr

*Assistant Examiner*—Moshe I. Cohen

*Attorney, Agent, or Firm*—Thomas S. Baker, Jr.

[57] ABSTRACT

An adapter-tip retainer pin has a wedge member and a lock member joined by a first pair of walls on a resilient member. The resilient member includes a central cavity and a second pair of walls which are curved inwardly toward the cavity such that the second pair of walls collapse inwardly when the retainer pin is compressed during insertion or removal from an adapter-tip assembly.

2 Claims, 3 Drawing Figures

DIPPER TIP RETAINING PIN

BACKGROUND OF THE INVENTION

This invention relates to a pin which retains a tooth tip on an adapter mounted on the lip of a dipper bucket.

A plurality of adapter-tip assemblies are mounted on the lip of a dipper bucket to scrape and dig material which goes into the bucket. Each adapter is rigidly affixed to the lip by one of several well-known means, including a C-clamp and wedge arrangement. The nose of the adapter projects beyond the lip and is received in the socket of a removable tooth tip. Aligned holes are formed in the wall defining the tooth tip socket and in the adapter. A pin is driven through one of the socket holes into the adapter hole and the opposite socket hole. The purpose of the pin is to retain the tooth tip on the adapter. When the tooth tip is to be removed from the adapter, the pin is driven out of engagement with the adapter and tip.

One type of retaining pin is a unitary assembly in which a wedge member and a lock member are joined together by a resilient member which has a rectangular cross-section and has a first pair of walls, one of which is bonded to the wedge member and the other is bonded to the lock member. The resilient member has a second pair of side walls which bulge outwardly between the lock member and the wedge member when the retainer pin is compressed. When the pin is driven through a hole in the tip socket for insertion into the adapter-tip assembly the resilient member is severly compressed. After it passes through that hole and into the hole in the adapter, which is slightly larger than and offset from the holes in the tip, the lock member snaps into place between the walls of the tip socket and the resilient member is compressed to a lesser degree. Compression of the resilient member retains the lock member in position. In order to remove the tip, the retaining pin is driven out of the adapter hole and through one of the socket holes.

It has been found that when the resilient member undergoes extreme compression, such as during insertion and removal through the holes in the tooth tip, the side walls bulge outwardly and engage or rub against the wall defining the tip hole. A problem with having the side walls bulge outwardly and engage the wall of the tooth tip hole is that it greatly increases the force required to drive the retaining pin in or out of the adapter-tip assembly. Another problem with having the side walls bulge outwardly when the pin is compressed is that, after the pin has been in position within the adapter for a period of time, very small particles of rock and ore pack securely around the retaining pin. These particles of rock and ore prevent the resilient member walls from bulging outwardly and lock the retaining pin in position.

In order to prevent the side walls from bulging outwardly in a similar pin, which is the subject of application Ser. No. 411,168 and assigned to the assignee of the instant invention, space was provided in the resilient material for the side walls to expand into when the pin was compressed during insertion or removal from the adapter-tip assembly. The space was a central cavity formed within the resilient member. However, it was found that even with a cavity in the resilient member the side walls of the member bulged outwardly away from the center of the resilient member when the member was compressed. Consequently, the pin was difficult to remove after particles of rock and ore had packed around it.

It is desirable to provide a unitary retaining pin in which a wedge member and a lock member are joined by a resilient member which is mounted between them and attached to one wall of each. Additionally, it is desirable to provide the resilient member with a means for preventing the outward bulging or expansion of its side walls when it is compressed during insertion or removal from an adapter-tip assembly.

SUMMARY OF THE INVENTION

The instant invention provides an adapter-tip retaining pin in which a wedge member and a lock member are joined by a resilient member which is between and bonded to each of the other members. The resilient member has a central cavity and the outer walls of the resilient member are narrower in the center than at the edges which engage the wedge and lock member walls, such that, when the retaining pin is under compression during insertion and removal from an adapter-tip assembly, the retaining pin side walls collapse inwardly towards the central cavity.

DESCRIPTION OF THE PREFERRED EMBODIMENT

Figure 1:
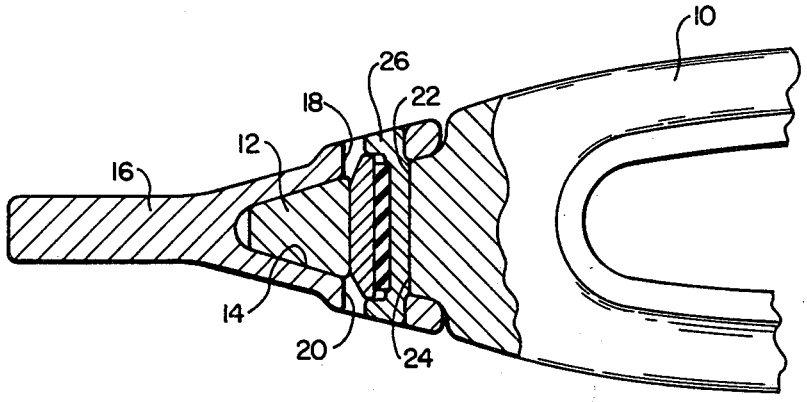
FIG. 1 is a cross-sectional view of a retaining pin of the instant invention mounted in an adapter-tip assembly.

Referring to FIG. 1, an adapter 10 which is mounted on the lip of a dipper bucket (not shown) has a nose 12 which is received within a complementary shaped socket 14 formed in the rear end of a tooth tip 16. A pair of holes 18, 20 are formed in the wall defining socket 14. A hole 22 is also formed in adapter nose 12 and is generally aligned with the holes 18, 20 in tip 16. The rear wall 24 of hole 22 is slightly offset from and outside of the rear walls of the holes 18, 20 in tip 16. The purpose of offsetting rear wall 24 with respect to holes 18, 20 is to accommodate a locking feature of a retainer pin 26 which will now be described.

Figure 2:
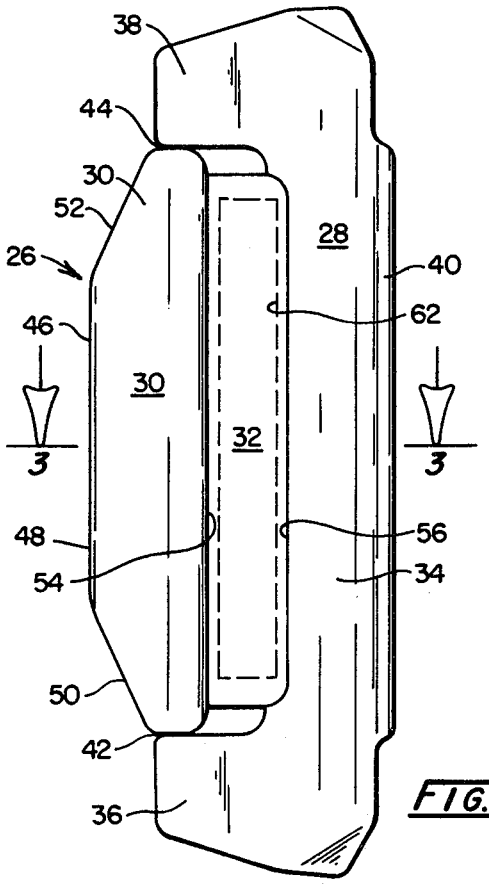
FIG. 2 is a side view of the retainer pin.
Figure 3:
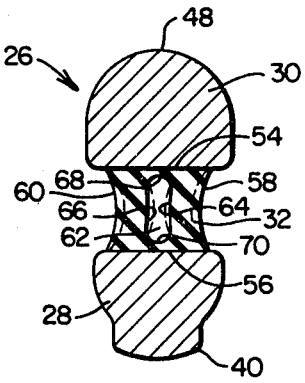
FIG. 3 is a view along line 3—3 of FIG. 2.

Referring to FIGS. 2 and 3, retainer pin 26 comprises three members: a U-shaped, longitudinal lock member 28, a wedge member 30 and a central resilient member 32 which is between and bonded to lock member 28 and wedge member 30. Lock member 28 includes a longitudinal, central body 34 and a pair of legs 36, 38 which project perpendicularly from each end of body 34 in the same direction. A longitudinally extending lock tab 40 projects from body 34 in a direction opposite to that from which the legs 36, 38 project. The length of lock tab 40 is approximately equal to the length of the rear wall 24 of adapter hole 22. The length of wedge member 30 is slightly less than the distance between lock member legs 36, 38. In fact, the legs 36, 38 overlie the ends 42, 44, respectively, of wedge member 30. Wedge member 30 includes a front surface 46 opposite resilient member 32 which has a central section 48 parallel to lock tab 40 and a pair of outer sections 50, 52 which taper inwardly from central section 48 to ends 42, 44, respectively.

The cross-sectional area of central resilient member 32 shown in FIG. 3 is defined by a pair of parallel, longitudinally extending walls 54, 56 which are bonded to wedge member 30 and lock member 28, respectively, and a pair of longitudinally extending outer side walls 58, 60 which are at right angles to the parallel walls 54, 56. The outer side walls 58, 60 are curved such that the centers of the walls 58, 60 are spaced closer to each other than the edges of the walls 58, 60 which engage the parallel walls 54, 56. A cavity 62 is centrally located in resilient member 32. Cavity 62 is defined by a pair of longitudinally extending walls 64, 66 which curve inwardly toward the center of cavity 62 and are generally parallel to the curved outer walls 58, 60, respectively, of member 32. The ends of cavity walls 64, 66 are joined by a pair of short convex end walls 68, 70. The centers of end walls 68, 70 project away from the center of cavity 62.

The function of retainer pin 26 is to retain tooth tip 16 on adapter 10. After adapter nose 12 is inserted in tooth tip cavity 14, such that holes 18, 20 in the wall defining cavity 14 are aligned with hole 22 in adapter 10, one leg 36, 38 of lock member 28 is set in a hole 18 with wedge member 30 facing the front end of tip 16 and lock member 28 is driven downwardly through the hole 18 until lock tab 40 snaps into adapter hole 22. When retainer pin 26 is initially driven into a tooth tip hole 18 one of the outer sections 50, 52 on wedge member 30 engage the front wall of adapter hole 22. As retainer pin 26 is driven through tooth tip hole 18 the front of adapter hole 22 engages the central section 48 of wedge member 30 and the lock tab 40 on lock member 28 engages the rear of the tooth tip hole 18. At this time the central resilient member 32 is at its state of maximum compression. Because the outer side walls 58, 60 of resilient member 32 are concave they tend to collapse inwardly toward the center of cavity 62. The position of the walls 58, 60 is shown in dotted lines in FIG. 3. The fact that the longitudinal walls 64, 66 defining cavity 62 are also concave and parallel to the outer side walls 58, 60 aids in causing the side walls 58, 60 to collapse inwardly as resilient member 32 is compressed. When retainer pin 26 is driven completely into the adapter-tip assembly such that lock tab 40 is entirely within adapter hole 22 there is less force tending to compress resilient member 32 since the lock tab 40 of lock member 28 can move to the rear wall 24 of adapter hole 22. Resilient member 32 remains in compression when lock tab 40 is in adapter hole 22. Further, the side walls 58, 60 of resilient member 32 remain collapsed inwardly toward cavity 62 but to a lesser degree than when the resilient member is compressed the maximum amount during insertion and removal of pin 26. Under no circumstances do the outer side walls 58, 60 bulge outwardly.

Consequently, when a retainer pin 26 has been in an adapter-tip assembly for a period of time and rock or ore powder has packed solidly around resilient member 32 the resilient member can still be compressed when it is driven out of the adapter-tip assembly because the side walls 58, 60 can collapse inwardly toward cavity 62. In other words, the solidly packed rock or ore powder cannot prevent the resilient member 32 from compressing to the degree necessary for removal of the retainer pin 26 since the side walls 58, 60 do not have to bulge outwardly against the powder.

Although a preferred embodiment of the invention has been illustrated and described, it will be apparent to those skilled in the art that various modifications may be made without departing from the spirit and scope of the present invention.

What is claimed is:

1. A pin for insertion into the pin receiving holes of a tip and the pin receiving hole of an adapter to retain the tip on the adapter which comprises: a U-shaped lock member including an elongated central body and a pair of legs which project one from each end of the body; a wedge member which is shorter than the distance between the legs and the legs overlie the wedge member; a resilient member which has a first pair of side walls of which one is bonded to the central body of the lock member and the other is bonded to the wedge member, a second pair of outer side walls which are positioned between the first pair of walls and extend between the lock member and wedge member, and means to collapse the second pair of walls inwardly when the resilient member is compressed upon insertion of the pin into the adapter and tip holes including a single centrally located sealed cavity formed within the resilient member, the surface defining each of the second pair of outer walls being concave such that the midpoints of the walls are spaced closer together than the ends of the walls adjacent the first pair of walls.

2. The pin of claim 1 wherein a first pair of cavity walls and a second pair of cavity walls define the cavity in the resilient member and each one of the first or second pair of cavity walls is concave and parallel to the second pair of outer side walls to ensure that the second pair of outer side walls collapse inwardly towards the cavity.

* * * * *